US006225947B1

(12) United States Patent
Johannisson

(10) Patent No.: US 6,225,947 B1
(45) Date of Patent: May 1, 2001

(54) BUTLER BEAM PORT COMBINING FOR HEXAGONAL CELL COVERAGE

(75) Inventor: Björn Johannisson, Kungsbacka (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/443,362

(22) Filed: Nov. 19, 1999

Related U.S. Application Data

(63) Continuation of application No. 09/072,332, filed on May 4, 1998, now Pat. No. 6,081,233.

(30) Foreign Application Priority Data

May 5, 1997 (SE) ..... 9701684

(51) Int. Cl.[7] ..... H01Q 3/22; H01Q 3/24; H01Q 3/26

(52) U.S. Cl. ..... 342/373

(58) Field of Search ..... 342/373

(56) References Cited

U.S. PATENT DOCUMENTS 4,231,040 * 10/1980 Walker .
4,424,500 * 1/1984 Viola et al. ..... 342/373
4,638,317 1/1987 Evans .
5,812,088 * 9/1998 Pi et al. ..... 342/373

FOREIGN PATENT DOCUMENTS

88/04837 6/1988 (WO) .

* cited by examiner

*Primary Examiner*—Theodore M. Blum
(74) *Attorney, Agent, or Firm*—Burns, Doane, Swecker & Mathis, L.L.P.

(57) ABSTRACT

An antenna arrangement and a method for obtaining such an antenna arrangement are disclosed. The antenna arrangement utilizes the beam ports of a beam forming network, e.g. a Butler matrix, in connection with a multi-element radiator antenna for obtaining receive/transmit channels having more antenna beams within a desired coverage. At least one extra signal combiner is utilized for combining at least one beam port of a number of ordinary beam ports with a nonadjacent beam port to form one receive/transmit channel in a number of desired receive/transmit channels. The particular receive/transmit channel uses the at least one extra signal combiner for combining at least one of a number of ordinary beam ports with a nonadjacent beam port normally being terminated, for adapting power and sensitivity distributions for a desired cell coverage or for desired coverage of overlapping cells.

15 Claims, 4 Drawing Sheets

BUTLER BEAM PORT COMBINING FOR HEXAGONAL CELL COVERAGE

This application is a continuation of U.S. patent application Ser. No. 09/072,332, entitled "BUTLER BEAM PORT COMBINING FOR HEXAGONAL CELL COVERAGE" filed on May 4, 1998 now U.S. Pat. No. 6,081,233.

TECHNICAL FIELD

The present invention relates to beam combining networks, and more exactly to a method for beam port combining for telecommunications cell coverage and an arrangement utilizing the method.

BACKGROUND

Each base station in a mobile telecommunications system requires a certain coverage area, for instance ±60°. By utilizing multi-beam antennas a mobile telecommunications system may gain both capacity and increased coverage. This is achieved by having a number of simultaneous narrow antenna beams from an antenna array illuminating the coverage area.

The following demands ought to be met for such a multi-beam antenna:

a) the antenna beams need to illuminate the entire intended coverage area;

b) a high antenna gain is aimed at, which results in narrow antenna beams. On the other hand the shape of the beams as well as side lobes is generally of less interest as long as the antenna gain is not influenced;

c) few receiver/transmitter channels is desired to reduce the system costs and complexity.

As is clear from the demands set forth above there is a contradiction when many narrow beams, covering a large area shall be accommodated within a few receiver/transmitter channels.

A standard method to obtain simultaneous narrow antenna beams from an antenna array normally utilizes a Blass or Butler matrix network for combining the individual antennas or antenna elements in an antenna array. In the literature can be found several methods utilizing a Butler matrix for feeding an antenna array having several antenna beams. In U.S. Pat. No. 4,231,040 to Motorola Inc., 1978, an apparatus and a method is disclosed for adjusting the position of radiated beams from a Butler matrix and combining portions of adjacent beams to provide resultant beams having an amplitude taper resulting in a predetermined amplitude of side lobes with a maximum of efficiency. This is achieved by first adjusting the direction of the beams by a set of fixed phase changers at the element ports of the Butler matrix. Two and two of adjacent beams are then combined by interconnections of the ports at the beam side of the Butler matrix. By this method 4 beams are achieved with an 8×8 matrix. However nothing is discussed about the coverage of the resulting beams.

Another document, U.S. Pat. No. 4,638,317 to Westinghouse, 1987, describes how the element ports of a Butler matrix fed array antenna are expanded to feed more elements than the basic matrix normally provides outputs for. By this distribution of power an amplitude weighting is achieved over the surface of the array antenna and the level of side-lobes is slightly reduced. In the present context this is of less relevance as such a device is intended as a component in a system for reduction of sidelobes. The number of beams is not changed. The coverage of the beams is shortly commented but casually. However the device will hardly be utilized as one single beam forming instrument.

Generally multiple beams from an antenna are usually achieved in a beam forming network, where transformations takes places between element and beam ports. Blass matrixes and Butler matrixes are examples of such transformations. The Butler matrix is interesting as it generates orthogonal beams, which results in low losses. FIG. 1 demonstrates, according to the state of the art, a Butler matrix with the two outer beam ports terminated to keep the number of receiver/transmitter channels down.

FIG. 2 demonstrates an example of a radiation pattern generated by such a beam forming matrix as illustrated in FIG. 1. The solid line beams are those connected to the four receiver/transmitter channels, while those with dashed lines are terminated and not being part of the system. As can be seen the coverage is not acceptable out at ±60°. The dotted line marks an example of a desired output for a hexagonal coverage. Consequently this antenna has a poor coverage at large radiation angles.

Nor can traditional beam forming at the outermost beam be used, as the antenna gain then decreases too much.

Thus there are still problems to be solved to be able to present a well behaving antenna system having a limited number of receive/transmit channels for a base station in mobile communication systems.

SUMMARY

According to the present invention a solution to the above indicated problems is a combination of at least one outermost beam port, otherwise terminated, and at least an already utilized beam port into a set which by means of a combiner/splitter will produce one receive/transmit channel within the number of receive/transmit channels. By utilizing a method and device according to the present invention more beam ports of the beam forming network will be taken advantage of, which also will result in obtaining receiver/transmitter channels which simultaneously have more beams covering different directions within a desired coverage area.

BRIEF DESCRIPTION OF THE DRAWINGS

The objects, features and advantages of the present invention as mentioned above will become apparent from a detailed description of the invention given in conjunction with the following drawings, wherein.

DETAILED DESCRIPTION

Figure 3:
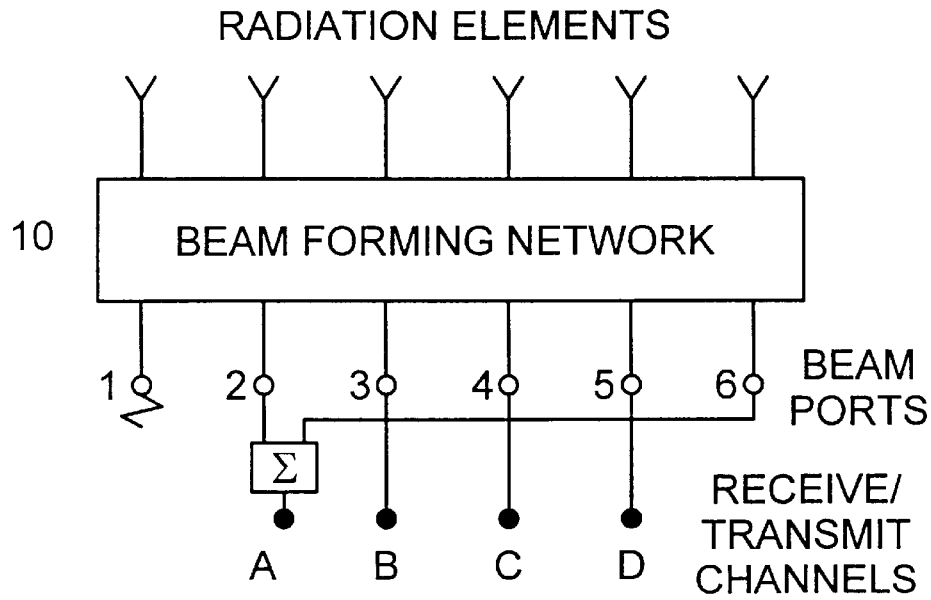
FIG. 3 illustrates a basic embodiment of a Butler matrix beam forming network for an array of 6 elements according to the present invention.

FIG. 3 illustrates, according to the present invention, a basic embodiment utilizing a 6×6 Butler matrix beam forming network 10 for an antenna array having 6 elements. The new method and antenna arrangement disclosed here combines in a combiner 11 one of the outermost previously terminated beam ports with one of the already utilized nonadjacent beam ports for the forming of one of four transmit/receive channels desired. For instance, such a combination is disclosed in FIG. 3. The disclosed combination of a second beam port 2 and a sixth beam port 6 will result in considerably wider coverage.

The device of the illustrative embodiment in FIG. 3 thus contains 6 radiation elements, which are connected to six beam ports 1–6 through the beam forming network constituting a 6×6 Butler matrix 10 having the sixth beam port 6 terminated in a usual way. However the device will still operate with four receive/transmit channels A–D.

Figure 1:
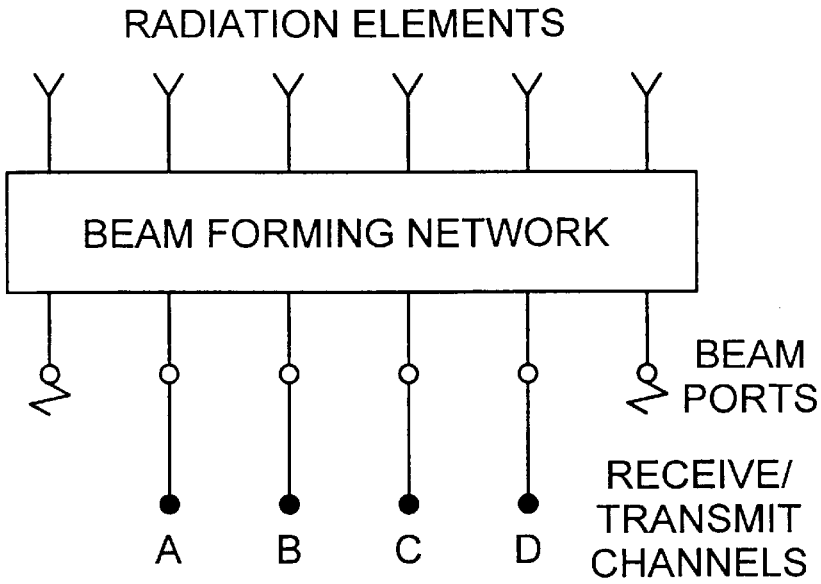
FIG. 1 PRIOR ART
FIG. 1 illustrates an example of a prior art Butler matrix beam forming network for an array of 6 elements.
Figure 4:
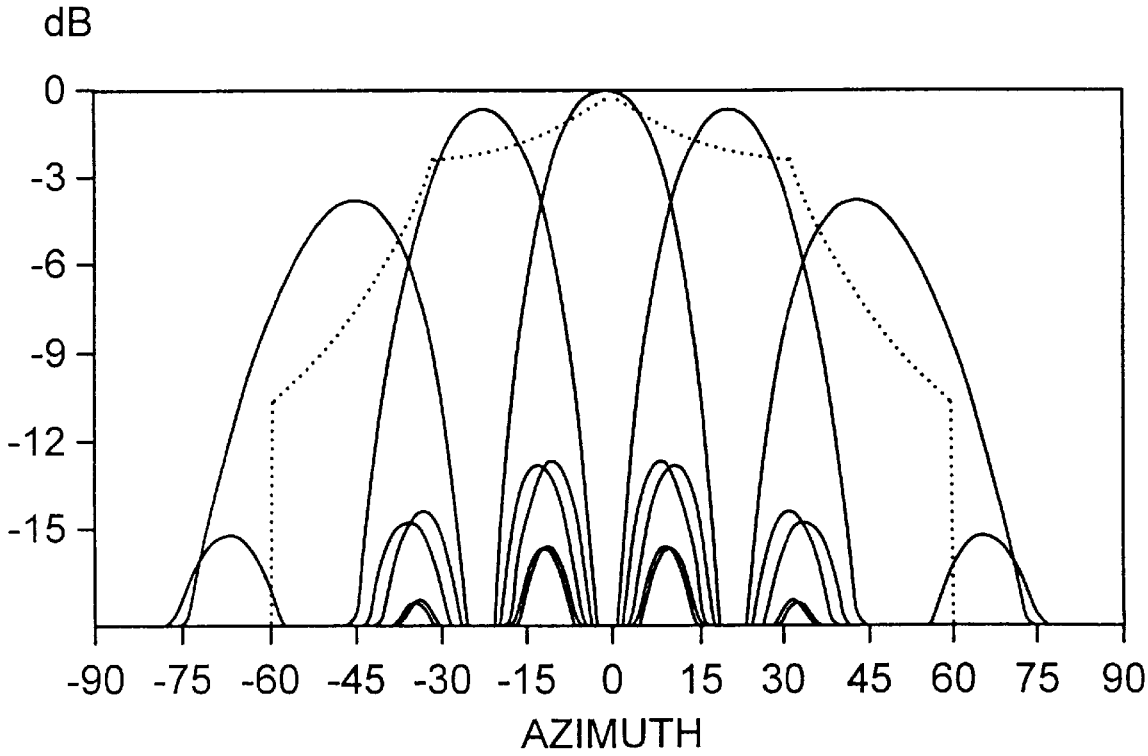
FIG. 4 illustrates beam port radiation patterns for the Butler matrix array according to FIG. 3.

As a nonadjacent port, preferably a port being most distant to the previously terminated port is used, i.e beam ports 2 and 6 or equally beam ports 1 and 5. The two beam ports are combined by a common combiner 11. As a result four receive/transmit channels A–D will still be obtained as illustrated in FIG. 1, where a first receive/transmit channel A of the four available receive/transmit channels is generated by combining beam ports 2 and 6. When utilizing five beam ports 2–6, alternatively 1–5, another beam formation will be obtained which slightly displaces the beam patterns, which is clearly demonstrated in the diagram of FIG. 4, compared to FIG. 2.

Figure 5:
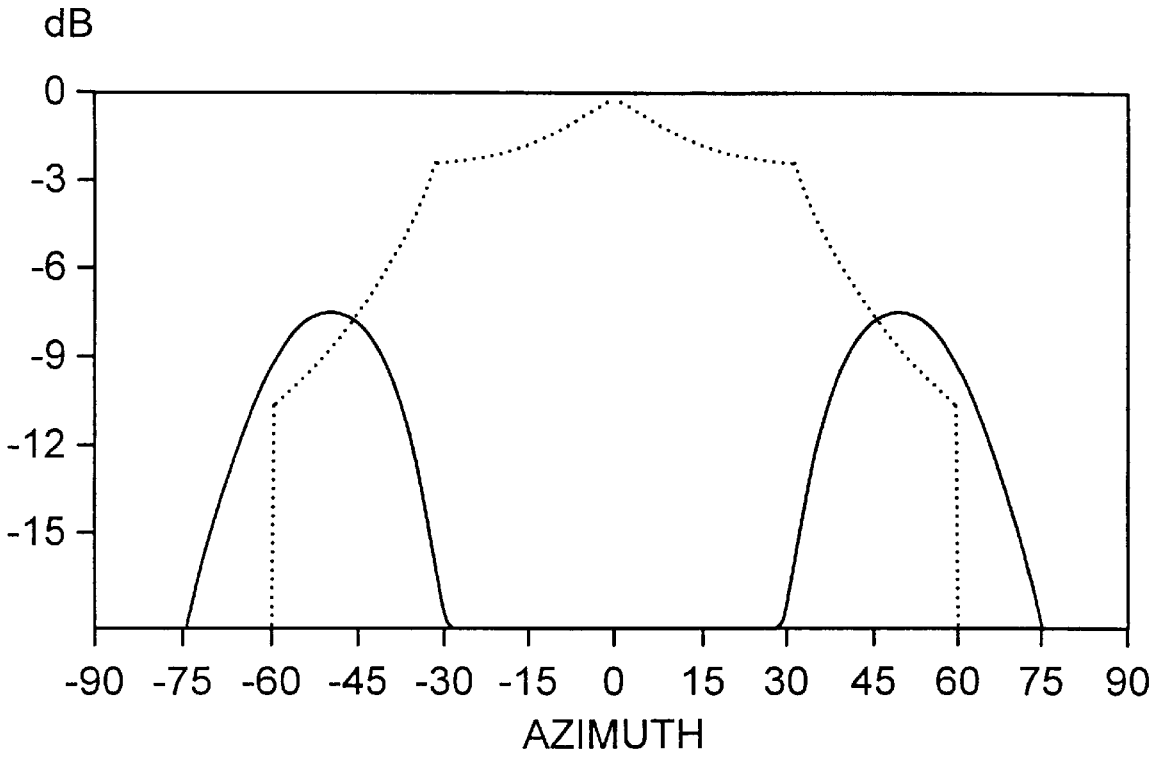
FIG. 5 illustrates the radiation pattern of the combined receiver/transmitter channel of the Butler matrix array according to FIG. 3.

FIG. 5 demonstrates a shape of the radiation pattern for the combined receiver/transmitter channel A constituting the combined beam ports 2 and 6. The radiation pattern will be displaced further out referenced to the direction perpendicular to the antenna array.

Figure 2:
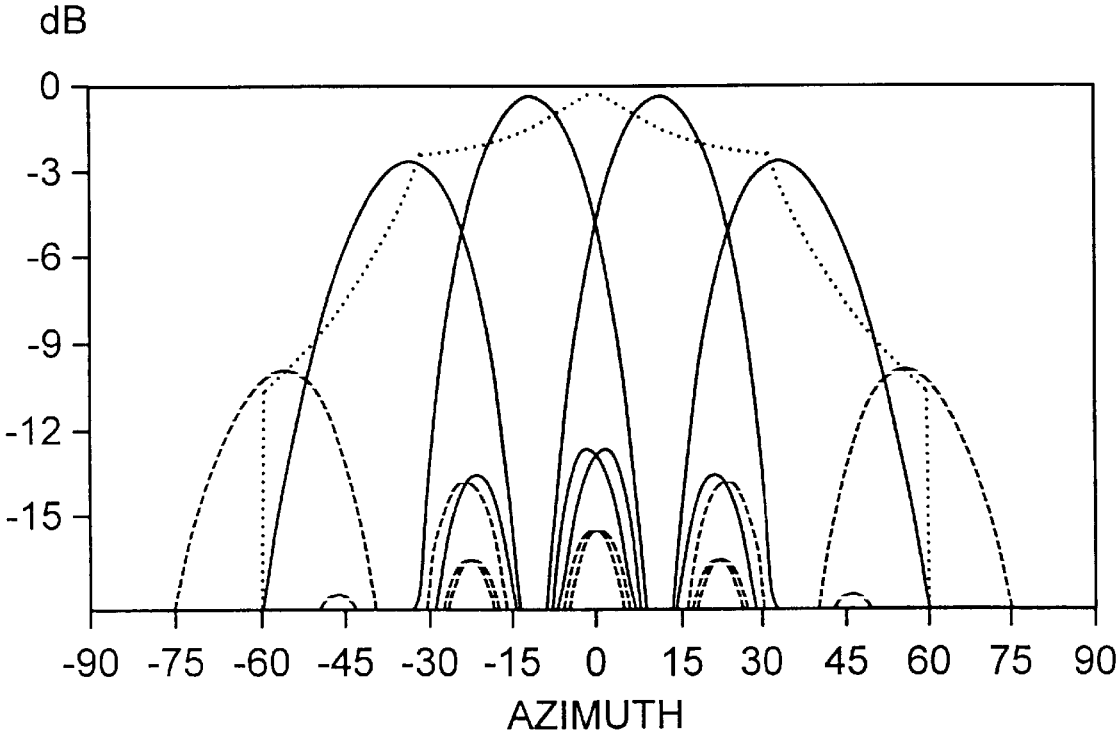
FIG. 2 PRIOR ART
FIG. 2 illustrates radiation patterns for the array according to FIG. 1.
Figure 6:
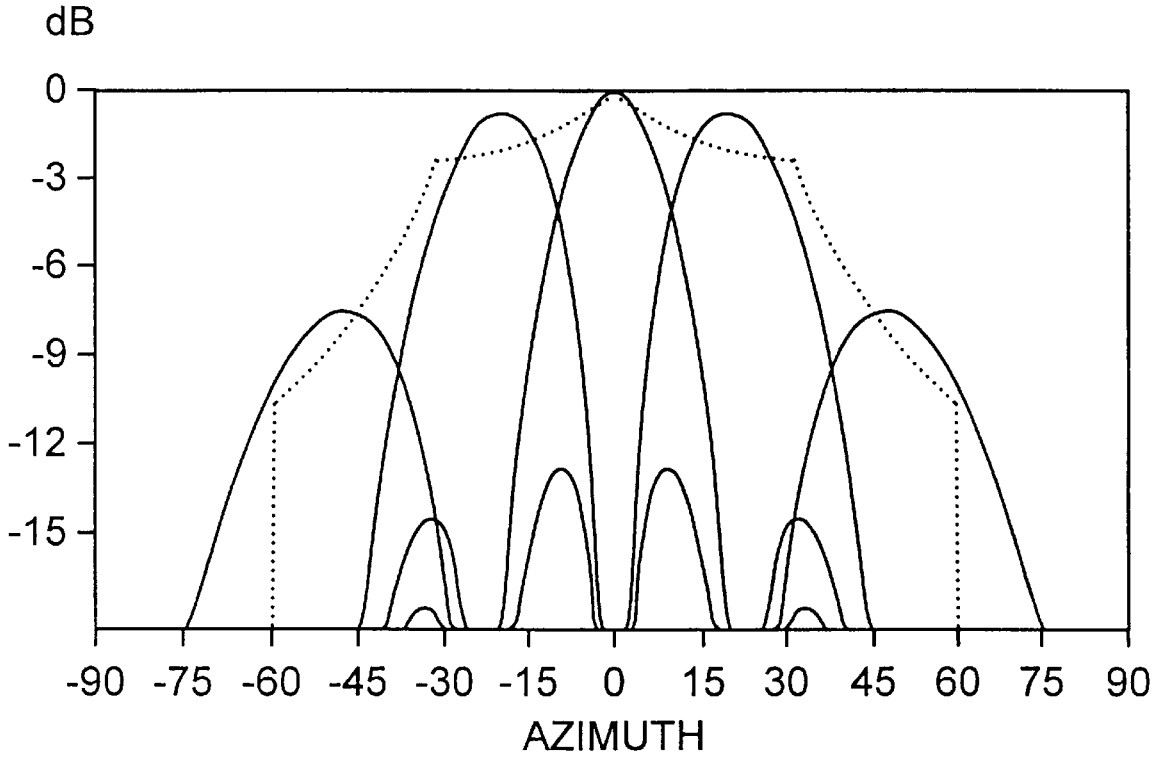
FIG. 6 illustrates the radiation patterns for all the four receiver/transmitter channels of the Butler matrix array in FIG. 3 according to the present invention.

FIG. 6 illustrates the radiation patterns for all the four receiver/transmitter channels of the Butler matrix array 10 in FIG. 3 embodying the present invention. In FIG. 6 it is easily observed that the radiation pattern, at a lowest desired radiation power level of −10 dB below peak power, goes out well beyond the desired ±60° in azimuth angle, compared to about ±50° at a corresponding radiation power level for the basic antenna arrangement of FIG. 1 as illustrated in FIG. 2.

The combination according to FIG. 3 will influence the antenna gain in these beam ports, but it can be well accepted for the directions where the gain demands are not as high.

Figure 7:
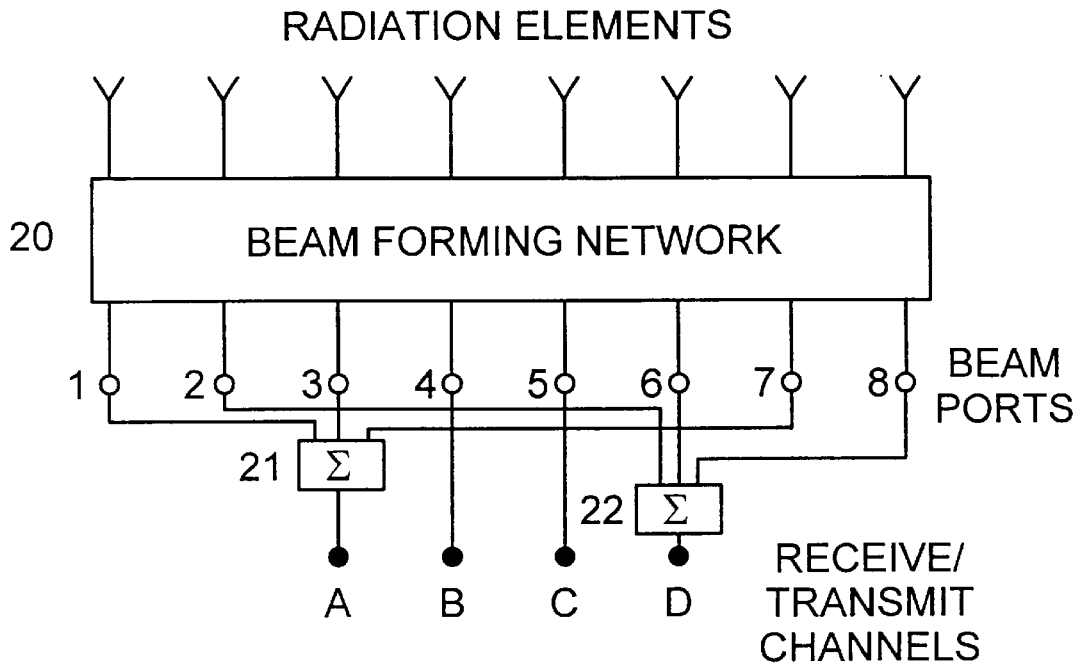
FIG. 7 illustrates an alternative embodiment utilizing the present invention.

In FIG. 7 an alternative embodiment is illustrated. This embodiment contains 8 radiation elements which are connected to eight beam ports 1–8 through a beam forming network 20 constituting for example an 8×8 Butler matrix. According to the invention beam ports 1, 3 and 7 are combined together to form the receiver/transmitter channel A and beam ports 8, 6 and 2 are combined together to form receiver/transmitter channel D. Thus the device will still operate with four receiver/transmitter channels A–D.

This is suitable, for instance for overlapping cells in a telecommunications system, if within a narrow area there is a demand for a high antenna gain at the same time as there is a need for a wide angle coverage. In this example an antenna having an width of eight antenna elements is utilized to optimize the antenna gain in the narrow area.

Figure 8:
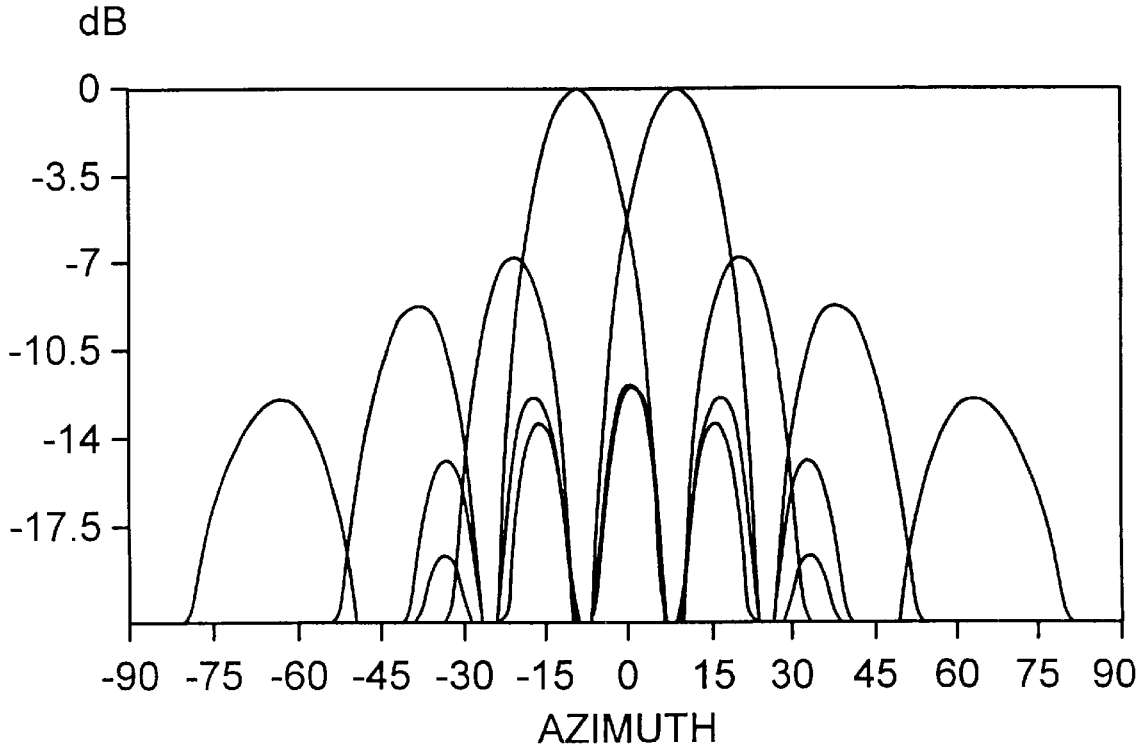
FIG. 8 illustrates the radiation patterns for receiver/transmitter channels of the Butler matrix array illustrated in FIG. 7 according to the present invention.

By combining three beam ports in each one of two additional combiners 21, 22 connected to the 8×8 matrix 20, the total number of receiver/transmitter channels is kept down to four, as is demonstrated in FIG. 7, in spite of using eight radiation elements. FIG. 8 demonstrates the corresponding radiation patterns for the four receiver/transmitter channels A–D. At −15 dB the array covers about ±70° of azimuth and presenting a narrow area of about ±15° at high gain. An additional advantage of the present invention is that the adaption of the power distribution will be obtained by still using output power amplifiers of identical power.

However according to the present invention it will be possible to introduce combiners even with more than three input terminals in cases of beam forming networks with an even greater number of radiation elements to still keep the number of channels for receive/transmit down. The number of receive/transmit channels may of course as well be chosen to other numbers than four.

Thus, it will be appreciated by those of ordinary skill in the art that the present invention can be embodied in many other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embodied therein.

What is claimed is:

1. A method for utilizing beam ports of a beam forming network, in a multi-element radiator array for creating receive/transmit channels having several antenna beams within a desired coverage area, comprising the steps of:

arranging at least one signal combiner separate from the beam forming network;

combining, by means of the at least one signal combiner separate from the beam forming network, at least one beam port with a nonadjacent, previously terminated, outermost beam port; and forming a receive/transmit channel within a number of desired receive/transmit channels by combining, by means of said at least one signal combiner having two input terminals and one output terminal, a beam port and a nonadjacent, previously terminated outermost beam port of the beam forming network, into one receive/transmit channel out of a plurality of receive/transmit channels, said beam port being combined with the nonadjacent, previously terminated, outermost beam port of the beam forming network whereby the combined beam ports represent beams being most distant from each other in the coverage area to thereby obtain a desired power and sensitivity distribution without causing an appreciable change in side-lobe coverage.

2. A method according to claim 1, wherein:

the beam forming network is a 6×6 Butler matrix;

output beam port number 6 is combined with output beam port number 2.

3. A method according to claim 1, wherein:

the beam forming network is a 6×6 Butler matrix; and output beam port number 1 is combined with output beam port number 5.

4. A method according to claim 1, wherein:

the beam forming network is an 8×8 Butler matrix; and output beam port number 8 is combined with output beam port numbers 6 and 2.

5. A method according to claim 1, wherein:

the beam forming network is an 8×8 Butler matrix; and output beam port number 1 is combined with output beam port number 7 and 3.

6. A method for utilizing beam ports of a beam forming network, in a multi-element radiator array for creating receive/transmit channels having several antenna beams within a desired coverage area, comprising the steps of:

arranging a first signal combiner and a second signal combiner each separate from the beam forming network;

forming a first receive/transmit channel within a number of desired receive/transmit channels, by combining, by means of the first signal combiner having three input terminals and one output terminal, a first outermost, previously terminated, beam port with two nonadjacent beam ports of the beam forming network, into a first receive/transmit channel out of a plurality of receive/transmit channels; and forming a second receive/transmit channel within a number of desired receive/transmit channels, by combining, by means of a second signal combiner having three input terminals and one output terminal, a second outermost beam port with two other nonadjacent beam ports of said beam forming network, into a second receive/transmit channel out of said plurality of receive/transmit channels, said previously terminated, first and second outermost beam ports being combined with the respective nonadjacent beam ports to thereby obtain a desired power and sensitivity distribution without causing an appreciable change in side-lobe coverage.

7. An antenna arrangement for utilizing beam ports of a beam forming network, in connection with a multi-element radiator antenna for obtaining receive/transmit channels having more antenna beams within a desired coverage area, the antenna arrangement comprising:

at least one signal combiner separate from the beam forming network, the at least on signal combiner having two input terminals and one output terminal for combining at least one previously terminated, outermost beam port with a nonadjacent beam port, to form a receive/transmit channel, wherein the receive/transmit channel uses the at least one signal combiner separate from the beam forming network to obtain a desired power and sensitivity distribution without causing an appreciable change in side-lobe coverage, said previously terminated, outermost beam port being combined with a nonadjacent beam port of the beam forming network whereby the combined beam ports represent beams being most distant from each other in the coverage area.

8. The antenna arrangement according to claim 7, wherein said beam forming network includes a Butler matrix.

9. The antenna arrangement according to claim 7, wherein:

the beam forming network is a 6×6 Butler matrix; and output beam port number 6 is combined with output beam port number 2.

10. The antenna arrangement according to claim 7, wherein:

the beam forming network is a 6×6 Butler matrix; and output beam port number 1 is combined with output beam port number 5.

11. The antenna arrangement according to claim 7, wherein:

the beam forming network is an 8×8 Butler matrix; and output beam port number 8 is combined with output beam port numbers 6 and 2.

12. The antenna arrangement according to claim 7, wherein:

the beam forming network is an 8×8 Butler matrix; and output beam port number 1 is combined with output beam port number 7 and 3.

13. An antenna arrangement for utilizing beam ports of a beam forming network, in connection with a multi-element radiator antenna for obtaining receive/transmit channels having more antenna beams within a desired coverage area, the antenna arrangement comprising:

a first and a second signal combiner each separate from the beam forming network for combining at least one previously terminated, outermost beam port with two nonadjacent beam ports, to form receive/transmit channels which use the first and second signal combiners to obtain desired power and sensitivity distributions without causing an appreciable change in side-lobe coverage, wherein the first signal combiner separate from the beam forming network has at least three input terminals and one output terminal, the three input terminals of the first signal combiner being connected to a first outermost beam port, a first nonadjacent beam port, and a second nonadjacent beam port respectively, thereby forming a first receive/transmit channel from the combined receive/transmit channels;

the second signal combiner separate from the beam forming network has at least three input terminals and one output terminal, the three input terminals being connected to a second outermost beam port, a third nonadjacent beam port, and a fourth nonadjacent beam port respectively, thereby forming a second receive/transmit channel from the combined receive/transmit channels;

such that the antenna arrangement produces a better adapted power/sensitivity distribution for overlapping cells in a telecommunication system.

14. The antenna arrangement according to claim 13, wherein:

the beam forming network is a 6×6 Butler matrix; and one of the combinations of output port number 6 being combined with output beam port number 2 and output port number 1 being combined with output beam port number 5.

15. The antenna arrangement according to claim 13, wherein:

the beam forming network is a 8×8 Butler matrix; and one of the combinations of output port number 8 being combined with output beam port numbers 6 and 2 and output port number 1 being combined with output beam port numbers 7 and 3.

* * * * *